United States Patent [19]

Ruthrof et al.

[11] Patent Number: 4,642,417

[45] Date of Patent: Feb. 10, 1987

[54] CONCENTRIC THREE-CONDUCTOR CABLE

[75] Inventors: Klaus Ruthrof, Erlangen; Rudolf Körner, Leinburg; Jürgen Dorner, Olching, all of Fed. Rep. of Germany

[73] Assignee: Kraftwerk Union Aktiengesellschaft, Mülheim, Fed. Rep. of Germany

[21] Appl. No.: 759,043

[22] Filed: Jul. 25, 1985

[30] Foreign Application Priority Data

Jul. 30, 1984 [DE] Fed. Rep. of Germany ..... 3428087

[51] Int. Cl.[4] ..... H01B 7/34

[52] U.S. Cl. ..... 174/36; 174/105 R; 174/106 R; 174/108; 174/109

[58] Field of Search ..... 174/36, 105 R, 107, 174/108, 109, 110 FC, 106 R

[56] References Cited

U.S. PATENT DOCUMENTS

| | | | |
|---|---|---|---|
| 2,376,101 | 5/1945 | Tyzzer | 174/105 R |
| 2,669,695 | 2/1954 | Bird | 174/36 |
| 3,163,836 | 12/1964 | Sugi et al. | 174/108 |
| 3,792,409 | 2/1974 | Smart et al. | 174/36 X |
| 3,812,283 | 5/1974 | Kothe et al. | 174/105 R |
| 4,301,428 | 11/1981 | Mayer | 174/36 X |
| 4,376,920 | 3/1983 | Smith | 174/105 R |
| 4,408,089 | 10/1983 | Nixon | 174/108 X |
| 4,499,438 | 2/1985 | Cornelius et al. | 174/36 X |

FOREIGN PATENT DOCUMENTS

| | | | |
|---|---|---|---|
| 527512 | 9/1954 | Belgium | 174/106 R |
| 604614 | 9/1960 | Canada | 174/107 |
| 485459 | 10/1953 | Italy | 174/106 R |

*Primary Examiner*—A. C. Prescott
*Assistant Examiner*—Morris H. Nimmo
*Attorney, Agent, or Firm*—Herbert L. Lerner; Laurence A. Greenberg

[57] ABSTRACT

A concentric three-conductor cable includes an inner conductor and outer conductors formed of braided strands, and insulating material separating the outer conductors from each other and from the inner conductor, each the other conductors being formed of a plurality of layers and the d-c resistance of the outer conductors being several times smaller than the d-c resistance of said inner conductor.

12 Claims, 1 Drawing Figure

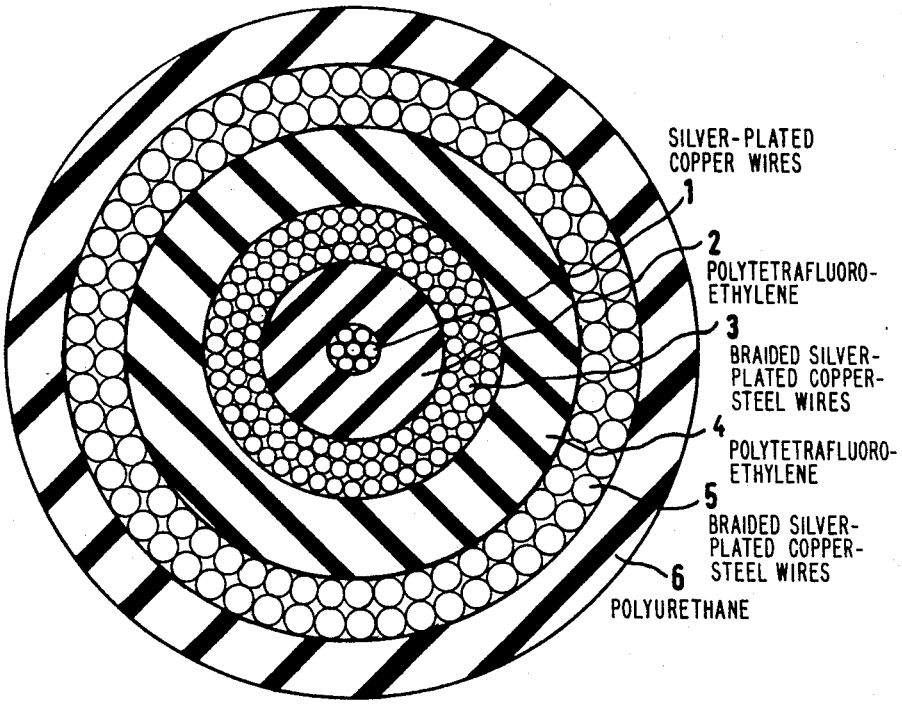
SILVER-PLATED COPPER WIRES
1
2
POLYTETRAFLUORO-ETHYLENE
3
BRAIDED SILVER-PLATED COPPER-STEEL WIRES
4
POLYTETRAFLUORO-ETHYLENE
5
BRAIDED SILVER-PLATED COPPER-STEEL WIRES
6
POLYURETHANE

CONCENTRIC THREE-CONDUCTOR CABLE

The invention relates to a concentric three-conductor cable, especially for ultrasonic measurements, with an inner conductor and outer conductors formed of braided strands which are spaced from each other and from the inner conductor by insulating material.

In order to achieve short shut-down times, particularly in nuclear power stations, important tests performed with ultrasound are performed simultaneously with repair operations which are connected through voice transmission by radio or which require arc welding. Therefore, rather strong electric and/or electromagnetic interference fields are experienced. Heretofore, the interference fields have frequently resulted in interruption of the ultrasonic tests because of interference voltages, in spite of using the above-mentioned three-conductor cables, and the tests have had to be rescheduled, for instance, to night hours.

It is accordingly an object of the invention to provide a concentric three-conductor cable which overcomes the hereinafore-mentioned disadvantages of the heretofore-known devices of this general type, and to reduce the pickup of interference voltages which can adversely affect the ultrasonic measurements through special construction of the cable.

With the foregoing and other objects in view there is provided in accordance with the invention, a concentric three-conductor cable, especially for ultrasonic measurements comprising an inner conductor and outer conductors formed of braided strands, and insulating material separating the outer conductors from each other and from the inner conductor, each of the outer conductors being formed of a plurality of layers and the d-c resistance of the outer conductors being several times smaller than the d-c resistance of the inner conductor.

The new cable has extremely high coupling attenuation. It is thus insensitive to the above-mentioned interference influences. It can nevertheless be constructed with a small diameter and high flexibility, as in-depth tests have shown.

In accordance with another feature of the invention, the ratio of the d-c resistance of the outer conductors to the d-c resistance of the inner conductor is at least 1:5. This substantially exceeds the values of conventional measuring cables, which have less coupling attenuation.

In accordance with a further feature of the invention, the outer conductors include a conductor adjacent or closest to the inner conductor being formed of at least three layers of braided silver-plated copper strands offset relative to each other meaning that each strand is disposed in the valley formed by the adjacent strands in an adjacent layer of strands for obtaining a high degree of coverage.

In accordance with an added feature of the invention, the outer conductors include an outermost conductor formed of silver-plated steel-copper wire or a similar ferromagnetic material. In particular, two or more layers are used, besides electrical shielding, so that direct magnetic shielding is also obtained without an adverse effect on the flexibility as in other steel-armored cables. In spite of this, excellent mechanical resistence against rough operation is obtained.

In accordance with an additional feature of the invention, the insulating material is polytetrafluoroethylene. The thickness between the inner conductor and the first outer conductor depends on the required wave impedance of the cable.

In accordance with yet another feature of the invention, there is provided an outer jacket having substantially the same thickness as the insulating material. This jacket is recommended as an external protection. The jacket is advantageously formed of polyurethane which can be dyed to make the cable more conspicuous or to identify it.

Other features which are considered as characteristic for the invention are set forth in the appended claims.

Although the invention is illustrated and described herein as embodied in a concentric three-conductor cable, it is nevertheless not intended to be limited to the details shown, since various modifications and structural changes may be made therein without departing from the spiritt of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is an enlarged cross-sectional view of the cable according to the invention.

Referring now to the FIGURE of the drawing in detail, there is seen the construction of a tri-axial cable with extremely high coupling attenuation, small diameter (approximately 6 mm), good flexibility as well as rugged construction which will be described in the direction from the inside out. The cable includes an inner conductor 1 formed of copper strands $7\times0.18$ silver plated, i.e., 7 copper wires with a diameter of 0.18 mm which are silver plated and twisted with each other. The d-c resistance is 100 mohm/m.

An adjacent dielectric 2 is formed of highly insulating material, namely, polytetrafluoroethylene which is extruded onto the inner conductor 1. An insulating material thickness of about 0.6 mm corresponds to an outside diameter of 1.7 mm. A wave impedance of about 50 ohm is obtained in this way.

An inner shielding 3 comprises three shields which are braided on top of each other and which are formed of silver-plated copper strands. The copper strands are spun in several lengths or lays, for instance, 16, each of which may have 5 or 6 conductors with a diameter of 0.1 mm to form an acute-angle braid. Overall, an outside diameter of 3.0 mm is obtained for the shielding 3 and a d-c resistance of 12 mohm/m. A very good degree of coverage is achieved with high flexibility due to these multiple shielding layers.

The inner shielding or shield 3 is followed by a second insulation 4. The insulation 4 is likewise formed of extruded polytetrafluoroethylene and has an outside diameter of 3.8 mm.

An outer shield 5 of the triaxial cable is formed of two shields braided on top of each other, that are formed of silver-plated wire made from a ferromagnetic alloy containing part copper and part steel or a similar ferromagnetic material which also permit the achievement of a high degree of coverage. In the shield 5, 24 lays or lengths of five or six individual conductors with a diameter of 0.13 mm are braided together at an acute angle. This results in an outside diameter of 5 mm and a d-c resistance of 17 mohm/m.

An outer jacket 6 is formed of polyurethane, which is preferably dyed and results in an outside diameter of 6 mm.

The decisive advantage gained through the use of the invention is the extremely high coupling attenuation of more than 140 dB of the cable. This is achieved by the use of multilayer shields which permit a high degree of coverage while at the same time providing a low series resistance and great flexibility.

The shielding effect relates not only to electric fields but also to magnetic fields by magnetostatic action, due to the use of steel-copper in the outer shield. The cable can therefore be employed not only for ultrasonic measurements, but also advantageously for reducing the interference sensitivity in data processing.

We claim:

1. Concentric three-conductor cable, comprising an inner conductor and outer conductors formed of braided strands, and insulating material separating said outer conductors from each other and from said inner conductor, each of said outer conductors being formed of a plurality of layers and the d-c resistance of said outer conductors being several times less than the d-c resistance of said inner conductor.

2. Cable according to claim 1, wherein the ratio of the d-c resistance of said outer conductors to the d-c resistance of said inner conductor is at least 1:5.

3. Cable according to claim 1, wherein said outer conductors include a conductor closest to said inner conductor being formed of at least three layers of braided silver-plated copper strands, each strand being disposed in the valleys formed by the adjacent strands in an adjacent layer of strands for obtaining a high degree of coverage.

4. Cable according to claim 1, wherein said outer conductors include an outermost conductor formed of silver-plated wire made from ferromagnetic alloy containing part copper and part steel.

5. Cable according to claim 3, wherein said outer conductors include an outermost conductor formed of silver-plated wire made from ferromagnetic alloy containing part copper and part steel.

6. Cable according to claim 1, wherein said outer conductors include an outermost conductor formed of ferromagnetic material.

7. Cable according to claim 3, wherein said outer conductors include an outermost conductor formed of ferromagnetic material.

8. Cable according to claim 1, wherein said insulating material is polytetrafluoroethylene.

9. Cable according to claim 8, including an outer jacket having substantially the same thickness as said insulating material.

10. Cable according to claim 8, including an outer jacket of dyed polyurethane having substantially the same thickness as said insulating material.

11. Cable having reduced interference sensitivity for the use in data processing comprising an inner conductor and outer conductors formed of braided strands, and insulating material separating said outer conductors from each other and from said inner conductor, each of said outer conductors being formed of a plurality of layers and the d-c resistance of said outer conductors being several times less than the d-c resistance of said inner conductor.

12. Cable having reduced interference sensitivity for use in ultrasonic measurements comprising an inner conductor and outer conductors formed of braided strands, and insulating material separating said outer conductors from each other and from said inner conductor, each of said outer conductors being formed of a plurality of layers and the d-c resistance of said outer conductors being several times less than the d-c resistance of said inner conductor.

* * * * *